US012274366B2

(12) United States Patent
Moridaira

(10) Patent No.: US 12,274,366 B2
(45) Date of Patent: Apr. 15, 2025

(54) AIR CUSHION

(71) Applicant: JUTE inc., Tokyo (JP)

(72) Inventor: Shigeo Moridaira, Tokyo (JP)

(73) Assignee: JUTE inc., Tokyo (JP)

( * ) Notice: Subject to any disclaimer, the term of this patent is extended or adjusted under 35 U.S.C. 154(b) by 320 days.

(21) Appl. No.: 17/920,802

(22) PCT Filed: May 16, 2022

(86) PCT No.: PCT/JP2022/020360

§ 371 (c)(1),
(2) Date: Oct. 24, 2022

(87) PCT Pub. No.: WO2023/166751

PCT Pub. Date: Sep. 7, 2023

(65) Prior Publication Data

US 2023/0284792 A1 Sep. 14, 2023

(30) Foreign Application Priority Data

Mar. 4, 2022 (JP) ..... 2022-033630

(51) Int. Cl.
*A47C 27/08* (2006.01)

(52) U.S. Cl.
CPC ..... *A47C 27/081* (2013.01); *A47C 27/087* (2013.01)

(58) Field of Classification Search
CPC ..... A47C 27/081; A47C 27/087; A47C 7/021
See application file for complete search history.

(56) References Cited

U.S. PATENT DOCUMENTS

| | | | | |
|---|---|---|---|---|
| 1,726,939 | A * | 9/1929 | Anderson | A47C 27/081 267/117 |
| 5,906,878 | A * | 5/1999 | Horning | A47C 31/11 297/219.1 |
| 7,810,193 | B1 * | 10/2010 | Ennis | A47D 13/08 297/284.6 |
| 9,144,314 | B2 * | 9/2015 | Li | A47C 7/021 |
| 2011/0107521 | A1 * | 5/2011 | Alder | A47C 27/081 5/706 |
| 2015/0061346 | A1 * | 3/2015 | Featherstone | A47C 7/021 297/452.41 |
| 2015/0366368 | A1 | 12/2015 | Cheng | |
| 2018/0199720 | A1 * | 7/2018 | Limpaitoon | A47C 7/0213 |

FOREIGN PATENT DOCUMENTS

| | | | |
|---|---|---|---|
| JP | 64-929 | * | 1/1989 |
| JP | 3000758 | U | 8/1994 |
| JP | H11-318644 | A | 11/1999 |
| JP | 2001-149395 | A | 6/2001 |
| JP | 2020-130198 | A | 8/2020 |

* cited by examiner

*Primary Examiner* — Myles A Throop
(74) *Attorney, Agent, or Firm* — Yokoi & Co., U.S.A.; Toshiyuki Yokoi

(57) ABSTRACT

There is provided an air cushion in which air chambers rise when a user is seated.
An air cushion including an outer welded portion along an outer peripheral portion of a flat bag-shaped object includes: a first air chamber as a seating portion; a second air chamber as a side support portion; and a third air chamber as a side support portion, wherein the air chambers communicate with each other through passage portions and an inner welded portion is provided that has a U character.

11 Claims, 11 Drawing Sheets

AIR CUSHION

TECHNICAL FIELD

The present invention relates to an air cushion, particularly to an air cushion that provides good support for the pelvis of a user or the like.

BACKGROUND ART

In recent years, with an increase of work at desk working at companies using a personal computer (PC), teleworking at home, and the like, the working hour for a user to perform predetermined work or the like in a state where the user is seated on a chair attached to a desk has been significantly increasing.

An increase in working hour at such desk working, teleworking, or the like is likely to cause excessive rearward inclination or forward inclination of the pelvis, thus leading to the hunched back or to the arched lumbar, and a burden is applied to the lumbar spine or to the thoracic vertebrae, which has been a serious cause of lumbar pain, intervertebral disc herniation, or the like.

Therefore, various types of cushions that provide improved usability of a user have been proposed.

As the cushion, for example, a cushion that can be adjusted in height according to a position or the like of the neck or the lumbar of a user in combination with a neck cushion, a mat, or the like has been proposed (for example, refer to Patent Document 1).

More specifically, as shown in FIG. 11A, there is provided a cushion 200 in which at least two airbags (201' and 201") containing respective elastic bodies such as a foam material inside are disposed to face each other in a vertical direction.

Then, in the cushion 200, one airbag (201') is provided with an air control unit for controlling the filling and discharging of air, passage holes and connection portions are formed on surfaces of the airbags facing each other, and the two airbags (201' and 201") are directly connected to each other.

In addition, a seating pressure-reducing air cushion capable of dispersing pressure applied to the buttocks in a state where a user is seated has been proposed (for example, refer to Patent Document 2).

More specifically, as shown in FIG. 11B, there is provided a seating pressure-reducing air cushion 300 including a main body 301; a pair of recesses 302 aligned with a position of the buttocks; a compression preventive hole 303 provided at the center; a hollow rim portion 304 provided on a periphery; and small air circulation holes connecting the main body 301 and the rim portion 304.

CITATION LIST

Patent Document

Patent Document 1: US 2015/0366368 A1 (claims, drawings, and the like)

Patent Document 2: JP 3000758 U (claims, drawings, and the like)

SUMMARY OF THE INVENTION

Problem to be Solved by the Invention

However, since the cushion described in Patent Document 1 is not structured to support the lumbar and the like of the user in a left-right direction, when the user is seated, the inclination of the pelvis may not be prevented, which is a problem.

In other words, when the user inclines the body in the left-right direction, an airbag itself does not follow the inclination of the pelvis even when combined with the neck cushion, the mat, or the like, and as a result, a burden on the lumbar spine or on the thoracic vertebrae may not be reduced, which is also a problem.

In addition, since the seating pressure-reducing air cushion described in Patent Document 2 also does not have a structure in which the rim portion on the periphery supports the lumbar in the left-right direction, depending on a body shape of the user or on a seating posture, the inflow of air to the rim on the periphery is not uniform, so that the inclination of the pelvis may not be prevented, which is a problem.

Further, the seating pressure-reducing air cushion has a complicated structure, requires a large number of manufacturing steps, is difficult to stably manufacture, and is likely to be economically disadvantageous, which is a problem.

Therefore, as a result of diligent efforts made in view of such problems, the inventors of this application have found that good support for the pelvis of a user or the like can be provided by providing a plurality of air chambers through a predetermined inner welded portion and by using a flow of filling air when the user is seated, and have completed the invention.

Namely, an object of the invention is to provide an air cushion configured such that due to a flow of filling air when a user is seated, a plurality of air chambers communicating with each other can rise along a vertical direction in an inclined state to wrap a periphery of the lumbar, and even when the user inclines the body in a left-right direction, good support for the pelvis or the like can be maintained.

Means for Solving Problem

According to the invention, there is provided an air cushion including an outer welded portion along an outer peripheral portion of a flat bag-shaped object, the cushion including: when viewed from above, at least a first air chamber as a seating portion; a second air chamber as a side support portion disposed on a left of the first air chamber; and a third air chamber as a facing side support portion disposed on a right of the first air chamber. The first air chamber communicates with the second air chamber and with the third air chamber through respective passage portions such that filling air moves between the first air chamber, the second air chamber, and the third air chamber. An inner welded portion is provided that has a U character (a U-shape) and that divides the first air chamber, the second air chamber, and the third air chamber from each other, so that the above-described problems can be solved.

Namely, according to the air cushion of the invention, when a user is seated, the first air chamber is compressed from above, so that a first inner welded portion is pushed downward, the filling air spreads to an outer peripheral portion side along a plane direction, and the second air chamber and the third air chamber rise easily along a vertical direction in a state where the second air chamber and the third air chamber are inclined inward.

Therefore, when the user is seated, predetermined air chambers can rise easily to support the pelvis such that a periphery of the pelvis is wrapped from the left and right, and even when the user inclines the body in a left-right direction, good support for the pelvis or the like can be maintained.

In other words, since the air cushion is easily and thinly folded into a compact shape when not used, and is lightweight, it is easy to carry or store the air cushion.

In addition, according to a configuration of the invention, when the inner welded portion having a U character is used as a first inner welded portion, it is preferable that separately from the first inner welded portion, one or a plurality of secondary first (secondary-first) inner welded portions each having a U character is provided in the first air chamber at predetermined intervals.

By employing such as a configuration, regardless of a body shape or a body weight of the user, seating comfort of the first air chamber can be further improved, and when the user is seated, the flow of the filling air can be more accurately controlled.

In addition, according to a configuration of the invention, when the inner welded portion having a U character is used as a first inner welded portion, it is preferable that a second inner welded portion is provided that is in contact with the first inner welded portion and that has at least one shape selected from a square shape, a rectangular shape, an inverted V character (V-shape), and an inverted U character (an inverted U-shape) when viewed from above.

By employing such as a configuration, direct air movement between the second air chamber and the third air chamber can be controlled, and when the user is seated, the flow of the filling air can be more accurately controlled.

In addition, according to a configuration of the invention, it is preferable that the air cushion further includes a fourth air chamber as a rear support portion disposed behind the first air chamber.

By employing such a configuration in which the fourth air chamber is provided, the pelvis can also be supported from behind, and the fourth air chamber can provide better support for the pelvis of the user or the like, together with the second air chamber and the third air chamber.

In addition, according to a configuration of the invention, it is preferable that when viewed from above, the flat bag-shaped object has a twin peak shape in which a lower outer peripheral portion of the flat bag-shaped object extends over the second air chamber and the third air chamber.

By employing such a configuration, the rising of the second air chamber and of the third air chamber can be more smoothly performed.

In addition, according to a configuration of the invention, it is preferable that the air cushion further includes an additional inner welded portion having a horizontal shape or a curved shape and extending over the second air chamber and the third air chamber.

By employing such a configuration in which the additional inner welded portion (hereinafter, may be referred to as a third inner welded portion) is provided, when the second air chamber and the third air chamber rise, these air chambers are folded along the third inner welded portion, so that contact with the lumbar can be further improved.

In addition, according to a configuration of the invention, it is preferable that an anti-slip portion having a predetermined regular pattern or a random pattern is provided on a surface of the seating portion.

By employing such a configuration in which the anti-slip portion is provided, an anti-slip property of the surface of the seating portion can be improved, and the filling air moves more smoothly, so that support for the pelvis can be improved.

In addition, according to a configuration of the invention, it is preferable that at least one of the second air chamber and the third air chamber is provided with a filling port of the filling air.

By employing such a configuration, a filling amount of the filling air or a discharge air amount can be easily and accurately controlled by a combination of a predetermined pump and the like.

MODE(S) FOR CARRYING OUT THE INVENTION

First Embodiment

Figure 1A:
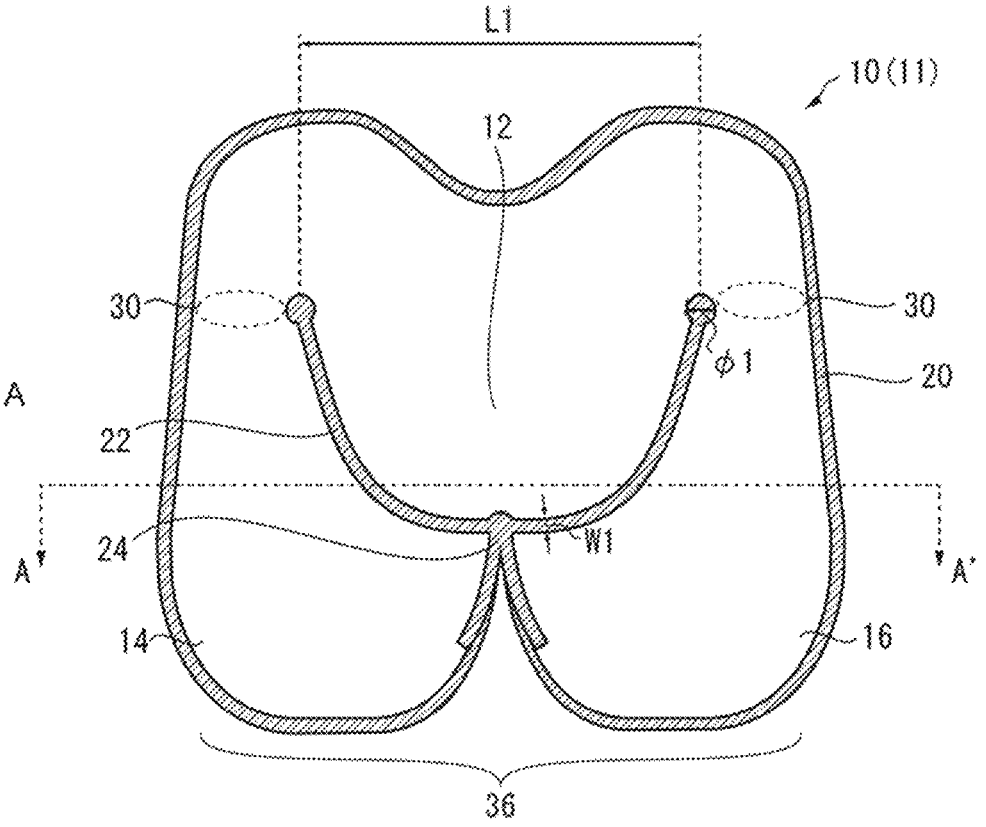
FIGS. 1A and 1B are general views of an air cushion of a first embodiment when viewed from above.

According to a first embodiment, as illustrated in FIG. 1A, there is provided an air cushion 10 including an outer welded portion 20 along an outer peripheral portion of a flat bag-shaped object 11, the air cushion 10 including: when viewed from above, at least a first air chamber 12 as a seating portion; a second air chamber 14 as a side support portion disposed on a left of the first air chamber 12; and a third air chamber 16 as a facing side support portion disposed on a right of the first air chamber 12. The first air chamber 12 communicates with the second air chamber 14 and with the third air chamber 16 through respective passage portions 30 such that filling air moves between the first air chamber 12, the second air chamber 14, and the third air chamber 16. A first inner welded portion 22 is provided that has a U character and that divides the first air chamber 12, the second air chamber 14, and the third air chamber 16 from each other.

Hereinafter, the first embodiment of the air cushion 10 of the invention will be specifically described with reference to the drawings as appropriate.

1. Flat Bag-Shaped Object

As shown in FIG. 1A, the flat bag-shaped object 11 (hereinafter, simply, may be referred to as the bag-shaped object 11) is a flat plate-shaped member as an exterior of the air cushion 10 that can hold air filled from a filling port (not shown) or the like, inside and that has a predetermined thickness in an air-filled state.

More specifically, it is preferable that a configuration in which outer peripheries of a pair of sheet-shaped objects are welded to form a bag shape, a configuration in which a sheet-shaped object is folded and outer peripheries other than a folding line are welded to form a bag shape, a configuration in which an opening portion of a sheet-shaped object having a tubular shape is welded to form a bag shape, or the like is employed.

The reason for this is that even with a simple configuration, the bag-shaped object 11 having a substantially flat plate shape suitable for the air cushion 10 capable of preventing air leakage to the outside can be formed.

(1) Material

In addition, a material of a pair of sheets forming the bag-shaped object is not particularly limited as long as air leakage to the outside can be prevented and welding can be performed, but normally, in the case of using a crystalline resin, it is preferable that a resin having a low melting point (in the case of using an amorphous resin, a glass transition temperature or a softening point) is used.

More specifically, it is preferable that a single-layer sheet made of at least one of polyvinyl chloride (PVC), polyethylene (PE), polypropylene (PP), polyester (PES), polycarbonate (PC), polyamide (PA), polyurethane (PU), thermoplastic elastomer (TPE), thermoplastic rubber (TPR), ethylene vinyl acetate copolymer (EVA), and the like, or a laminate of a plurality of sheets derived from a plurality of resins is used.

The reason for this is that the bag-shaped object that is easily melt by predetermined welding, that has an elastic modulus within a desired range, and that has flexibility can be obtained by using one or a combination of a plurality of sheets derived from such resins.

Further, the reason for this is that by the use of sheets derived from such resins, the bag-shaped object can have good strength against external impact or against internal air pressure and provide good support for the pelvis for a long period of time.

Incidentally, in order to improve artificial leather properties and the like in addition to texture or decorativeness of the air cushion, it is preferable that raised sheets, sheets subjected to fine surface embossing or to fine surface treatment, or the like made of the above-described materials as the material of the pair of sheets are used.

In addition, a melting point of the material forming the bag-shaped object is not particularly limited as long as the melting point is a temperature where the material is not damaged by the use of a welding device or the like, but normally, the melting point is preferably a value within a range of 50 to 300° C.

The reason for this is that in the case of having such a melting point, the material is unlikely to be damaged by the use of the welding device or the like and has flexibility suitable for the air cushion.

Therefore, the melting point of the material forming the bag-shaped object is more preferably a value within a range of 60 to 280° C., further preferably a value within a range of 80 to 250° C.

In addition, it is preferable that a protective cover is provided around or on surfaces of the bag-shaped object.

The reason for this is that by providing the protective cover, durability can be further improved and contact sensation when a user is seated can be further improved.

Namely, it is preferable that the protective cover is made of a woven fabric woven with a fiber.

Specifically, it is preferable that the protective cover is made of a woven fabric woven with at least one fiber of a polyester fiber, a polyurethane fiber, a polyethylene fiber, a polyamide fiber, and the like, and it is more preferable that the protective cover is made of a woven fabric obtained by weaving a covered yarn in which another fiber is wound around the fiber as a core yarn.

(2) Shape

In addition, a planar shape of the bag-shaped object is not particularly limited as long as the lumbar below the buttocks which is continuous with the buttocks can be supported, but normally, it is preferable that when viewed from above, the bag-shaped object has at least one of a circular shape, an elliptical shape, a triangular shape, an inverted triangular shape, a quadrilateral shape (including a square shape and a rectangular shape), a polygonal shape (for example, pentagonal to octagonal shapes), a rhombus shape, an irregular shape, a shape in which a part of these shapes is recessed inward, and the like.

The reason for this is that by employing such a shape, even with a simpler configuration, a relatively wide seating area can be ensured, and the second air chamber and the third air chamber rise easily, thereby being able to easily provide good support for the pelvis.

In addition, from the viewpoint of further improving support for the pelvis, it is more preferable that when viewed from above, the bag-shaped object has at least one of an inverted protrusion shape, a gourd shape in which large and small circles overlap each other, an inverted pot shape, a spade shape, and the like such that a fourth air chamber to be described later is shaped to protrude rearward.

In addition, it is preferable that when the flat bag-shaped object is viewed from above, the planar shape of the bag-shaped object is a twin peak shape in which a lower outer peripheral portion of the flat bag-shaped object extends over the second air chamber and the third air chamber.

Specifically, as shown in FIG. 1A, it is preferable that a lower outer peripheral portion 36 of the bag-shaped object 11 has a twin peak shape at a portion extending over the second air chamber and the third air chamber.

The reason for this is that the rising of the second air chamber and of the third air chamber is more smoothly performed by employing such a shape.

(3) Size

In addition, a maximum diameter indicating a size of the planar shape of the bag-shaped object is not particularly limited as long as the maximum diameter has a value where the bag-shaped object can be laid below the buttocks to support the lumbar, but normally, is preferably set to a value within a range of 150 to 1000 mm.

The reason for this is that by setting such a maximum diameter, when the bag-shaped object is laid on a chair or on the ground and the user is seated, the bag-shaped object can be prevented from swaying in a front-rear direction and in a left-right direction and can more stably support the pelvis.

Therefore, the maximum diameter of the planar shape of the bag-shaped object is more preferably set to a value within a range of 300 to 800 mm, further preferably a value within a range of 400 to 700 mm.

Incidentally, the maximum diameter of the planar shape of the bag-shaped object can be defined as a diameter of a circumscribed circle of the planar shape of the bag-shaped object.

(4) Thickness in Air-Filled State

Figure 2A:
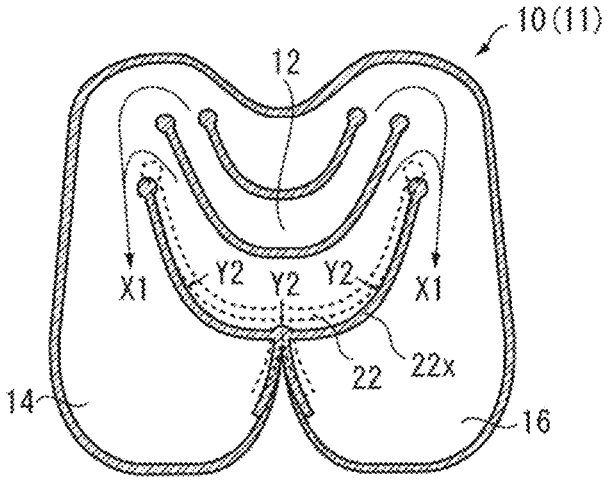
FIGS. 2A to 2C are views provided to describe flows of air and the mechanism of accompanying rising of air chambers in the air cushion of the first embodiment.
Figure 2B:
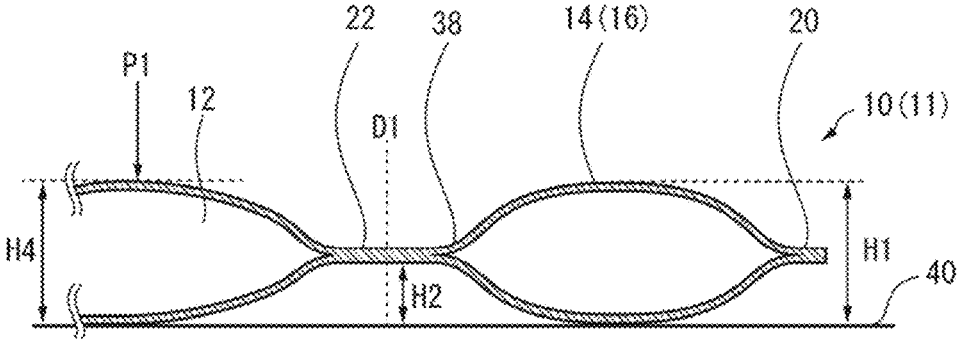

In addition, a thickness of a bag-shaped portion can be defined as a height H1 of an uppermost surface of the bag-shaped object along a vertical direction with reference to an installation plane in an air-filled state (refer to FIG. 2B).

In this case, the thickness of the bag-shaped portion is suitably set to a thickness that can provide appropriate cushioning when the user is seated, and can be appropriately changed in consideration of a body shape, a body weight, or the like of the user, but normally, is preferably set to a value within a range of 10 to 150 mm.

The reason for this is that by setting such a thickness, when the bag-shaped object is laid on a chair or on the ground and the user is seated, the bag-shaped object can have good adhesion to the buttocks and can be prevented from excessively sinking to further improve support for the pelvis.

Therefore, the thickness of the bag-shaped object is more preferably set to a value within a range of 20 to 120 mm, further preferably a value within a range of 30 to 100 mm.

2. Outer Welded Portion

As shown in FIG. 1A, the outer welded portion 20 is a portion in which a welding surface is formed into a flat or embossed shape by welding at least a part of the outer peripheral portion of the bag-shaped object 11 through heating, pressurizing, or the like using a predetermined welding device, to prevent the filling air from leaking to the outside of the bag-shaped object 11.

In addition, in order to improve sealability or the like, it is preferable that the outer welded portion is provided with an adhesive layer as an intermediate layer between the pair of sheet-shaped objects to be welded.

Specifically, it is preferable that as the adhesive layer, normally, at least one of a hot-melt adhesive, an epoxy adhesive, a urethane adhesive, an acrylic adhesive, an EVA adhesive, an SBR adhesive, an NBR adhesive, and the like is used.

The reason for this is that by providing such an adhesive layer, various sheets can be firmly bonded to each other without any gap therebetween and a leakage amount of the filling air flowing out to the outside of the bag-shaped object can be further reduced.

In addition, a width of the outer welded portion is not particularly limited as long as adhesive strength to prevent peeling of the welded portion can be maintained when the air cushion is repeatedly used while seated, but normally, is preferably set to a value within a range of 3 to 30 mm.

The reason for this is that by setting such a width, the sheets can be firmly bonded to each other without a gap therebetween and the filling air can be more effectively prevented from leaking to the outside of the bag-shaped object.

Therefore, the width of the outer welded portion is more preferably set to a value within a range of 4 to 25 mm, further preferably a value within a range of 5 to 20 mm.

3. Air Chambers (1) First Air Chamber

As shown in FIG. 1A, when the bag-shaped object is viewed from above, the first air chamber 12 is a portion disposed in front of the first inner welded portion 22, and is a portion to be laid below the buttocks as a seating portion.

Specifically, the first air chamber 12 communicates with the second air chamber 14 and with the third air chamber 16 to be described later through the passage portions 30 to be described later, and is configured to push out the air with which the inside is filled, to the second air chamber 14 and to the third air chamber 16 by receiving pressure when the user is seated.

In addition, a height of the first air chamber 12 can be defined as a height H4 of the uppermost surface of the bag-shaped object forming the first air chamber 12, along the vertical direction with reference to the installation plane in an air-filled state (refer to FIG. 2B).

In this case, the height of the first air chamber 12 is not particularly limited as long as sufficient cushioning for the ischium can be ensured, but normally, is preferably set to a value within a range of 5 to 60 mm.

The reason for this is that when the user is seated in the first air chamber 12, cushioning for the coccyx of the user is further improved by setting such a height.

In addition, the reason for this is that a volume of the first air chamber is further increased by setting such a height, and when the user is seated, the air flows easily from the first air chamber to the second air chamber 14 and to the third air chamber 16 to be described later, and the second air chamber 14 and the third air chamber 16 rise easily.

Therefore, when the inside is filled with the air, the height of the first air chamber 12 is more preferably set to a value within a range of 10 to 55 mm, further preferably a value within a range of 15 to 50 mm.

(2) Second Air Chamber and Third Air Chamber

As shown in FIG. 2, the second air chamber 14 and the third air chamber 16 are configured as side support portions that rise in an inclined state along the vertical direction when the filling air flows in along arrow X1 (refer to FIG. 2A).

Furthermore, the second air chamber 14 and the third air chamber 16 are portions that wrap the lumbar from the periphery to support the pelvis from the left and right, and are configured to be disposed on the left of and on the right of the first air chamber 12, respectively, with the first inner welded portion 22 to be described later interposed therebetween when viewed from above.

Specifically, the second air chamber 14 and the third air chamber 16 communicate with the first air chamber 12 through the passage portions 30 to be described later, and are configured to rise when the air flows in from the first air chamber 12.

Hereinafter, the mechanism of rising of each air chamber will be specifically described with reference to FIGS. 2A to 2C.

First, the air cushion 10 is installed on a seating surface 40 of a chair. At this time, a lowermost surface of the first inner welded portion 22 is not in contact with the seating surface 40 of the chair, and is located at a height H2 (refer to FIG. 2B) from the seating surface 40 of the chair.

Next, the user is seated in the air cushion 10, so that the first air chamber 12 receives pressure P1 from above.

Then, the air of the first air chamber 12 flows into the second air chamber 14 and into the third air chamber 16 along paths indicated by arrow X1, to inflate the second air chamber 14 and the third air chamber 16.

Further, the lowermost surface of the first inner welded portion 22 moves from the height H2 toward the seating surface 40 of the chair, and at the same time, extends from a reference line Dl to a position 22*x* of a first inner welded portion along a plane in a Y1 direction.

Accordingly, the outer welded portion 20 is pivotally pushed up in a Y2 direction with respect to end portions 38 on a second air chamber 14 side and on a third air chamber 16 side of the first inner welded portion 22.

Figure 2C:
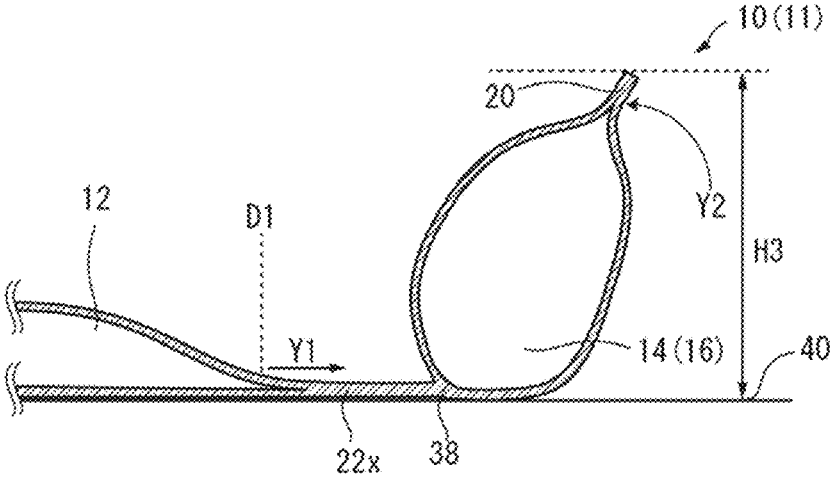

Namely, the second air chamber 14 and the third air chamber 16 rise to a height H3 (refer to FIG. 2C).

Therefore, the second air chamber 14 and the third air chamber 16 rise easily with respect to a valley formed along the first inner welded portion 22 and serving as a folding line.

Incidentally, the height H3 of the second air chamber 14 and of the third air chamber 16 in a raised state can be defined as a height of an uppermost portion of the bag-shaped object forming the second air chamber 14 and the third air chamber 16, along the vertical direction with respect to the installation plane in an air-filled state (refer to FIG. 2C).

In addition, the height H3 of the second air chamber and of the third air chamber in a raised state is not particularly limited as long as a periphery of the lumbar can be supported, but normally, is preferably set to a value within a range of 50 to 250 mm.

The reason for this is that by setting such a height, the periphery of the lumbar can be stably pressed and support for the pelvis can be further improved.

Therefore, the height of the second air chamber and of the third air chamber is more preferably set to a value within a range of 60 to 200 mm, further preferably a value within a range of 80 to 150 mm.

(3) Fourth Air Chamber

In addition, it is also preferable that the fourth air chamber is provided as an air chamber, in addition to the first air chamber, the second air chamber, and the third air chamber.

Figure 3A:
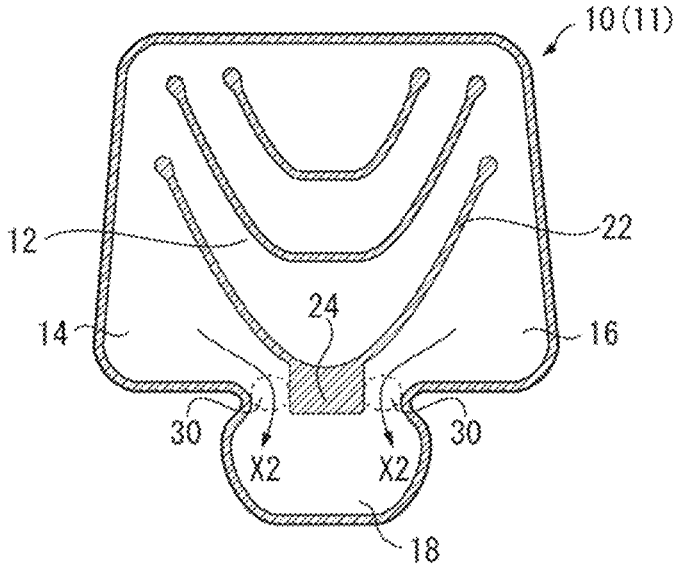
FIGS. 3A and 3B are views provided to describe respective specific examples of other air cushions in the first embodiment.
Figure 3B:
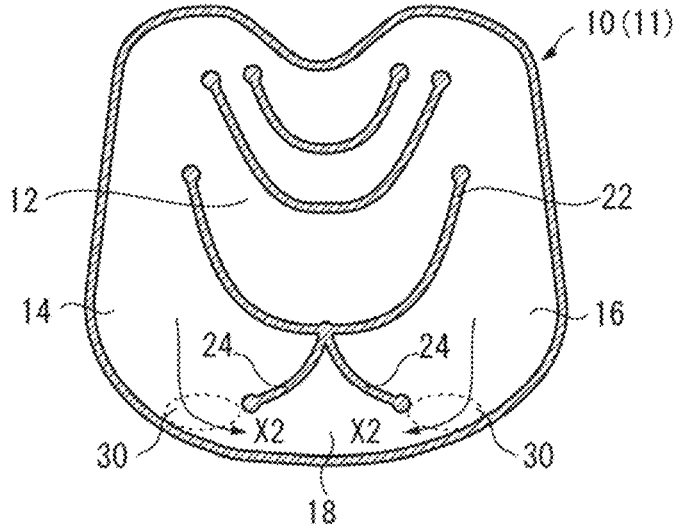

Specifically, as shown in FIGS. 3A and 3B, a fourth air chamber 18 is a rear support portion that rises when the air flows in along arrow X2 passing through the passage portions 30, and presses the lumbar to support the pelvis from behind, and it is also preferable that the fourth air chamber 18 is configured to be disposed behind the first air chamber 12 with a second inner welded portion 24 to be described later interposed therebetween when viewed from above.

The reason for this is that by adding the rear support portion as a support portion, the rear support portion can more stably press the periphery of the lumbar, together with the second air chamber and the third air chamber, and support for the pelvis can be further improved.

In addition, as the mechanism of rising of the fourth air chamber 18, a configuration can be considered in which motions of the second air chamber 14, of the third air chamber 16, and of the first inner welded portion 22 when the second air chamber 14 and the third air chamber 16 rise are replaced with motions of the fourth air chamber 18 and of the second inner welded portion 24.

Specifically, when the user is seated, the air of the first air chamber 12 flows into the fourth air chamber 18 to inflate the fourth air chamber 18.

Further, the second inner welded portion 24 is pushed downward, an outer welded portion of the fourth air chamber 18 is pushed upward, so that the fourth air chamber 18 rises.

In addition, it is preferable that a height of the fourth air chamber in a raised state is configured to be basically the same as that of the second air chamber and of the third air chamber, but it is also preferable that the height is configured to vary within a predetermined range in consideration of a usage environment, the body shape of the user, or the like.

In addition, when the body is inclined to the left or to the right to apply pressure to the second air chamber or to the third air chamber, the fourth air chamber is configured to receive an inflow of the air in the air chamber to push out the air to the other air chamber.

The reason for this is that by employing such a configuration, even when the body is inclined to the left or to the right, good support for the pelvis can be maintained.

4. Inner Welded Portion (1) Main Configuration

Figure 1B:
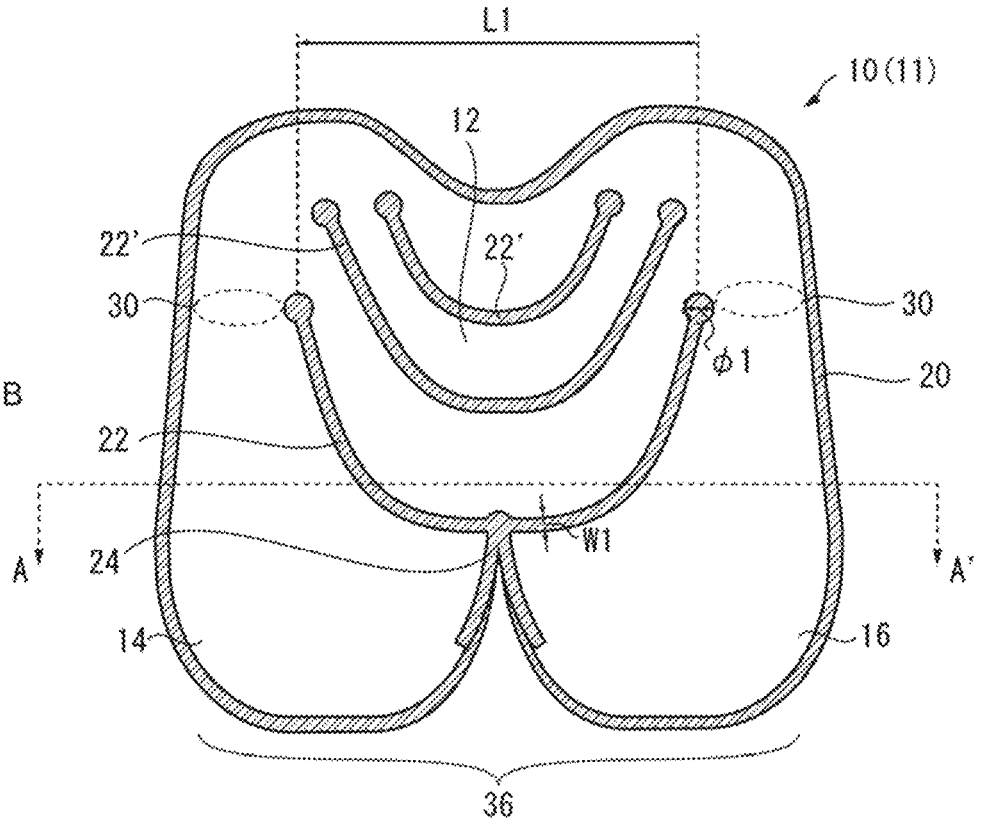

Regarding a main configuration of an inner welded portion, as shown in FIGS. 1A and 1B, the inner welded portion is a portion which partitions the first air chamber 12, the second air chamber 14, and the third air chamber 16 off from each other, and in which a welding surface is formed into a flat or embossed shape by welding a predetermined location of the bag-shaped object through heating, pressurizing, or the like using a welding device such that a flow of the air is controlled by the guide of the inner welded portion.

Therefore, it is preferable that the welded portion has basically the same configuration as that of the outer welded portion 20, and it is also preferable that the welded portion has a different form in consideration of the ease of formation or welding strength.

(2) First Inner Welded Portion

As shown in FIGS. 1A and 1B, the first inner welded portion 22 partitions the first air chamber 12, the second air chamber 14, and the third air chamber 16 off from each other, and is a welded portion that is curved in a U character when viewed from above.

Specifically, it is preferable that a shape of the first inner welded portion 22 is a line shape.

The reason for this is that the air can be more stably guided by employing such a shape.

Incidentally, the "U character" is a shape that curves or bends so that the ends of the inner welded portion are close to each other and has at least one crest between the ends.

So, the "U character" of the inner welded portion of the invention is defined as a shape in which a diameter of a circle inscribed in the inner welded portion is smaller than a diameter of a circle inscribed in the air cushion when viewed from above.

Therefore, the "U character" of inner welded portion of the invention includes not only the U character of the alphabet but also similar character to the U character.

In addition, a shape of an end portion of the first inner welded portion is not particularly limited as long as it is difficult for weld to come off, but normally, it is preferable that the end portion has at least one of a circular shape, an elliptical shape, a quadrilateral shape (including a square shape and a rectangular shape), a polygonal shape (for example, pentagonal to octagonal shapes), an arrow shape, a T shape, a trumpet shape, and the like.

The reason for this is that when the bag-shaped object is filled with the air, wrinkles generated in the bag-shaped object can be effectively prevented from concentrating and decreasing in support.

Furthermore, as shown in FIGS. 1A and 1B, when the shape of the end portion of the first inner welded portion 22 is a predetermined shape, a circle equivalent diameter of the predetermined shape is $\phi 1$, and a width of the first inner welded portion 22 is W1, it is preferable that the following relational expression (1) is satisfied.

$$\phi 1 > W1 \quad (1)$$

The reason for this is that by configuring the size (circle equivalent diameter or the like) of the end portion of the inner welded portion to be relatively large in such a manner, an area of an end of the first inner welded portion 22 can be increased and fixability or sealability can be improved.

In addition, the reason for this is that when the user is seated, the flow of the filling air can be controlled in a desired mode by setting the shape of the end portion of the first inner welded portion 22 to a predetermined shape and by satisfying the above relational expression (1).

In addition, a length L1 of the first inner welded portion (refer to FIGS. 1A and 1B), namely, an end portion-to-end portion distance is preferably set to a value within a range of 100 to 700 mm.

The reason for this is that by setting such an end portion-to-end portion distance, the volumes of the first air chamber, of the second air chamber, and of the third air chamber can be well balanced and the air in the first air chamber can be easily and more stably guided to the second air chamber and to the third air chamber.

Therefore, the end portion-to-end portion distance of the first inner welded portion is more preferably set to a value within a range of 200 to 600 mm, further preferably a value within a range of 300 to 500 mm.

In addition, the width W1 of the first inner welded portion (refer to FIGS. 1A and 1B) is not particularly limited as long as during use, leakage between the air chambers through the welded portion can be prevented and adhesive strength to prevent peeling of the welded portion can be maintained, but normally, is preferably set to a value within a range of 3 to 30 mm.

The reason for this is that by setting such a width, the inner welded portion can be firmly bonded without any gap and a leakage amount between the air chambers through the inner welded portion can be further reduced.

Therefore, the width of the inner welded portion is more preferably set to a value within a range of 4 to 25 mm, further preferably a value within a range of 5 to 20 mm.

In addition, normally, the circle equivalent diameter ϕ1 of the end portion of the first inner welded portion is preferably set to a value within a range of 5 to 35 mm.

The reason for this is that by setting such a circle equivalent diameter, when the air flows, airflow turbulence can be effectively prevented and the air can be more stably guided to the communicating air chamber.

Therefore, the circle equivalent diameter ϕ1 of the end portion of the first inner welded portion is more preferably set to a value within a range of 6 to 30 mm, further preferably a value within a range of 8 to 25 mm.

In addition, as shown in FIG. 1B, it is preferable that separately from the first inner welded portion 22, one or a plurality of secondary first inner welded portion 22' each having a U character are provided in the first air chamber 12 at predetermined intervals.

The reason for this is that regardless of the body shape or the body weight of the user, seating comfort of the first air chamber can be further improved and when the user is seated, the flow of the filling air can be more accurately controlled.

In addition, when the secondary first inner welded portion is formed of a plurality of welded portions, it is preferable that the number of the welded portions of the secondary first inner welded portion is within a range of 2 to 10.

The reason for this is that by setting such a number, the air in the first air chamber can be easily and stably guided to the second air chamber and to the third air chamber, a rising characteristic of the second air chamber and of the third air chamber can be further improved, and the pelvis can be more stably supported.

Therefore, the number of the welded portions of the secondary first inner welded portion is more preferably set to a value within a range of 3 to 8, further preferably a value within a range of 4 to 6.

In addition, when the secondary first inner welded portion is formed of a plurality of welded portions, it is preferable that the welded portions of the secondary first inner welded portions are configured to be disposed in a ripple pattern in which intervals therebetween are widened from the front toward the rear.

The reason for this is that the first air chamber can be divided into a plurality of ripple-shaped segments and a variation in air amount to be pushed out from the first air chamber when the user is seated can be more easily suppressed.

In addition, when the secondary first inner welded portion is formed of a plurality of welded portions, an interval between the welded portions of the secondary first inner welded portion is preferably set to a value within a range of 10 to 300 mm.

The reason for this is that a variation in air amount to be pushed out from the first air chamber when the user is seated can be more easily suppressed by employing the configuration in which the welded portions are disposed at such intervals.

Therefore, the interval between the welded portions of the secondary first inner welded portion is more preferably set to a value within a range of 20 to 200 mm, further preferably a value within a range of 30 to 150 mm.

In addition, when the secondary first inner welded portion is formed of a plurality of welded portions, it is preferable that intervals between the welded portions of the secondary first inner welded portion are narrowed sequentially from the rear.

The reason for this is that when the bag-shaped object is filled with the air, the first air chamber can be inclined forward and support for the pelvis can be further improved.

Therefore, the intervals between the welded portions of the secondary first inner welded portion are preferably narrowed sequentially from the rear by 3 to 50 mm, more preferably by 5 to 40 mm, and further preferably by 8 to 30 mm.

(3) Second Inner Welded Portion

In addition, it is preferable that the second inner welded portion is provided as an inner welded portion, in addition to the first inner welded portion.

Specifically, as shown in FIGS. 1A, 1B, 3A, 3B, 4A, and 4B, it is preferable that the second inner welded portion 24 is in contact with the first inner welded portion 22, and has at least one shape selected from a square shape, a rectangular shape, an inverted V character, and an inverted U character when viewed from above.

The reason for this is that direct air movement between the second air chamber and the third air chamber can be prevented by employing such a shape.

In addition, when the second inner welded portion is a welded portion having a square shape, a length of one side is preferably set to a value within a range of 30 to 150 mm.

The reason for this is that direct air movement between the second air chamber and the third air chamber can be more reliably prevented by setting such a length.

Therefore, the length of one side of the square shape of the second inner welded portion is more preferably set to a value within a range of 35 to 120 mm, further preferably a value within a range of 40 to 100 mm.

In addition, when the second inner welded portion is a welded portion having a rectangular shape, a length of a long side is preferably set to a value within a range of 35 to 160 mm.

The reason for this is that weldability can be further improved by setting such a length.

Therefore, the length of a long side of the rectangular shape of the second inner welded portion is more preferably set to a value within a range of 40 to 130 mm, further preferably a value within a range of 45 to 110 mm.

In addition, when the second inner welded portion is a welded portion having a rectangular shape, a length of a short side is preferably set to a value within a range of 30 to 150 mm.

The reason for this is that direct air movement between the second air chamber and the third air chamber can be more reliably prevented by setting such a length.

Therefore, the length of a short side of the rectangular shape of the second inner welded portion is more preferably set to a value within a range of 35 to 120 mm, further preferably a value within a range of 40 to 100 mm.

In addition, when the second inner welded portion is a welded portion having an inverted V character or an inverted U character, it is preferable that the shape of the second inner welded portion is a line shape (including a straight line and a curved line).

The reason for this is that the air can be more stably guided by employing such a shape.

In addition, when the second inner welded portion is a welded portion having an inverted V character or an inverted U character, a length of the second inner welded portion, namely, an end portion-to-end portion distance is preferably set to a value within a range of 50 to 350 mm.

The reason for this is that by setting such an end portion-to-end portion distance, the volumes of the first air chamber, of the second air chamber, and of the third air chamber can be well balanced and support for the pelvis by the second air chamber and by the third air chamber can be improved.

Therefore, the end portion-to-end portion distance of the second inner welded portion is more preferably set to a value within a range of 60 to 300 mm, further preferably a value within a range of 80 to 250 mm.

In addition, when the second inner welded portion is a welded portion having an inverted V character or an inverted U character, a width of the second inner welded portion is not particularly limited as long as during use, leakage between air chambers through the welded portion can be prevented and adhesive strength to prevent peeling of the welded portion can be maintained, but normally, is preferably set to a value within a range of 3 to 50 mm.

The reason for this is that by setting such a width, the inner welded portion can be firmly bonded without any gap and a leakage amount between the air chambers through the inner welded portion can be further reduced.

Therefore, the width of the inner welded portion is more preferably set to a value within a range of 5 to 40 mm, further preferably a value within a range of 8 to 30 mm.

In addition, when the second inner welded portion is a welded portion having an inverted V character or an inverted U character, it is preferable that a shape of an end portion of the second inner welded portion is configured to be basically the same as that of the first inner welded portion, but it is also preferable that the shape is configured to vary from the viewpoint of widening the width of the passage portions.

In addition, although not particularly shown, it is preferable that a folding portion is provided between the first inner welded portion and the second inner welded portion.

Specifically, it is preferable that as the folding portion, a constricted portion, a broken line-shaped portion that is welded in a broken line shape along the left-right direction, a bellows portion including embossings on a surface in a zigzag pattern, or the like is provided in the bag-shaped object.

The reason for this is that by providing such a folding portion in such a manner, a rising characteristic of the fourth air chamber can be improved and support for the pelvis can be further improved.

(4) Third Inner Welded Portion

In addition, it is preferable that an additional inner welded portion (hereinafter, may be referred to as a third inner welded portion) is provided as an inner welded portion, in addition to the first inner welded portion and the second inner welded portion.

Figure 4A:
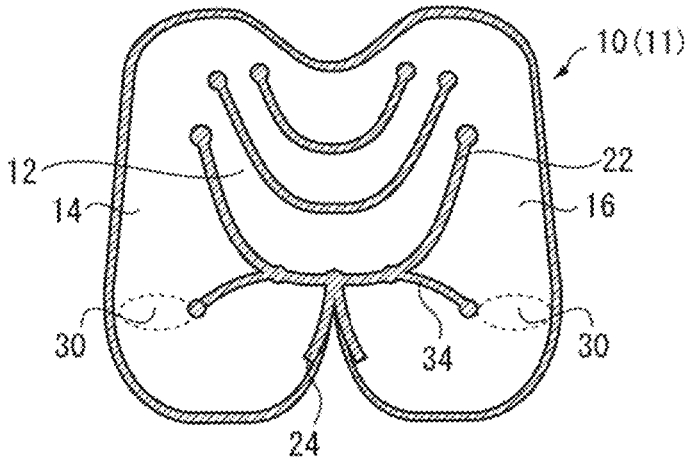
FIGS. 4A and 4B are views provided to describe respective specific examples of further other air cushions in the first embodiment.

Specifically, as shown in FIG. 4A, it is preferable that a third inner welded portion 34 extends over the second air chamber 14 and the third air chamber 16.

The reason for this is that by providing the third inner welded portion in such a manner, when the second air chamber and the third air chamber rise, the second air chamber and the third air chamber are folded by means of the third inner welded portion functioning as a folding portion, thereby being able to improve contact with the lumbar and to also support the pelvis from behind.

In addition, it is preferable that the third inner welded portion has a horizontal shape or a curved shape.

The reason for this is that the second air chamber and the third air chamber are folded by means of such a shape, thereby being able to further improve contact with the lumbar.

(5) Modification Examples

In addition, as a modification example of the inner welded portion, although not shown, it is preferable that a shape is employed in which the first inner welded portion and the second inner welded portion are disposed apart from each other by a predetermined interval and left end portions of the inner welded portions are connected and right end portions of the inner welded portions are connected by straight lines.

The reason for this is that by employing such a shape, a welded portion having a straight line shape can be formed and the second air chamber and the third air chamber can rise more easily along the welded portion.

In addition, as another example, although not shown, it is preferable that a shape is employed in which the first inner welded portion having a V character and the second inner welded portion having an inverted V character are disposed with apexes thereof joined together.

The reason for this is that by employing such a shape, a welded portion is easily formed even by a simple welding device.

5. Passage Portion

As shown in FIGS. 1A and 1B, when the bag-shaped object 11 is viewed from above, the passage portion 30 is a portion corresponding to a break in a welded portion, namely, a non-welded portion, and is a portion serving as a flow path through which the air passes between predetermined air chambers.

Specifically, it is preferable that at least one non-welded portion is provided between a distal end of the welded portion and the outer peripheral portion and the passage portion 30 formed of such a non-welded portion is provided along the outer peripheral portion.

The reason for this is that insufficient inflation in the vicinity of the outer peripheral portion can be more easily prevented by disposing a predetermined passage portion in such a manner.

Incidentally, when the cushion is viewed from above, regarding the width of the passage portion, namely, when the passage portion is a portion between the distal end of the welded portion and the outer peripheral portion, normally, a distance therebetween is preferably set to a value within a range of 5 to 80 mm, more preferably a value within a range of 10 to 60 mm, and further preferably a value within a range of 20 to 40 mm.

6. Anti-Slip Portion

As shown in FIG. 1, it is preferable that when the bag-shaped object 11 is viewed from above, an anti-slip portion 32 is provided on a seating portion, namely, the bag-shaped object 11 corresponding to a surface of the first air chamber 12.

The reason for this is that by employing the seating portion on which the anti-slip portion is provided in such a manner, an anti-slip property of the seating portion can be improved, and the filling air moves more smoothly, thereby being able to improve support for the pelvis.

In addition, a shape of the anti-slip portion 32 is not particularly limited as long as a predetermined anti-slip property can be exhibited, but normally, it is preferable that the anti-slip portion 32 has a circular or elliptical dot shape, a line shape, a triangular shape, a quadrilateral shape (including a square shape and a rectangular shape), a honeycomb shape, or a predetermined regular pattern of or a random pattern of a polygonal shape or an irregular shape.

Figure 5A:
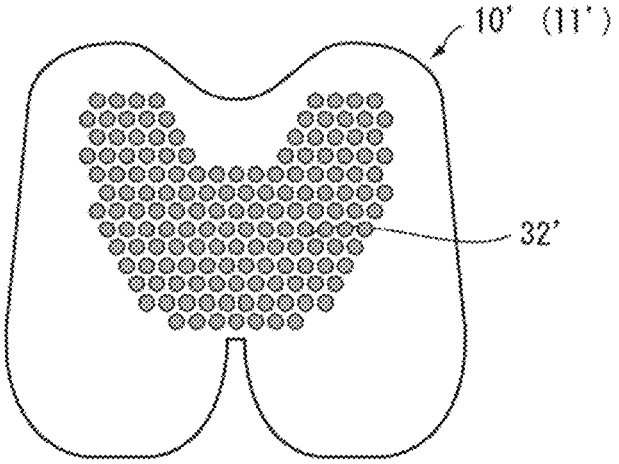
FIGS. 5A to 5C are views provided to describe respective predetermined regular patterns in an anti-slip portion of the first embodiment.
Figure 5B:
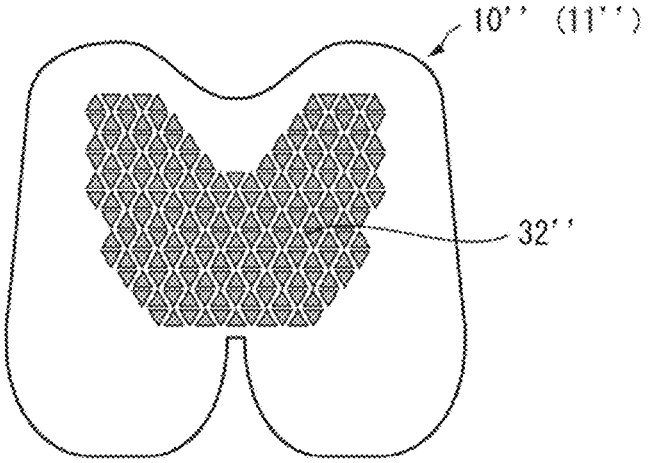
Figure 5C:
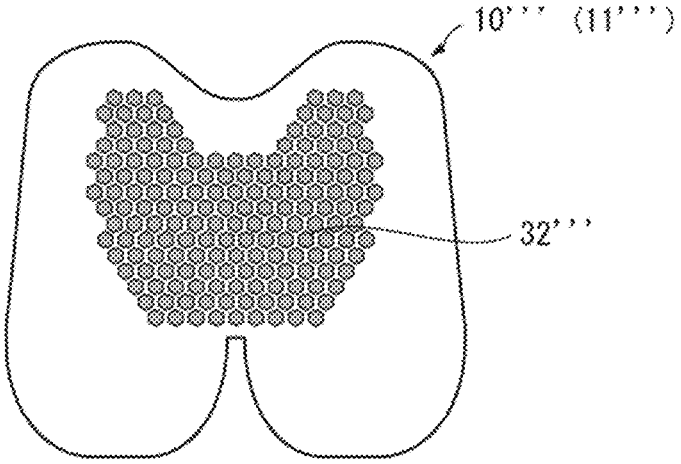

More specifically, as shown in FIGS. 5A to 5C, it is preferable that anti-slip portion 32' to 32''' have a dot shape, a triangular shape, or a polygonal shape and includes recesses and protrusions or one thereof in three dimensions.

In addition, although not shown, it is preferable that the anti-slip portion includes recesses each having an inverted dot shape, an inverted triangular shape, or an inverted polygonal shape in which recesses and protrusions of the predetermined pattern are inverted.

The reason for this is that a good anti-slip property and the like can be maintained over a long period of time by employing such a configuration.

In addition, a material of the anti-slip portion is not particularly limited as long as a predetermined anti-slip property can be exhibited, but normally, it is preferable that the anti-slip portion is made of a rubber material consisting of at least one of silicone rubber, urethane rubber, acrylic rubber, nitrile rubber, fluorine rubber, natural rubber, and the like.

The reason for this is that by using such a rubber material, not only the anti-slip property of the seating portion but also an anti-fouling property or cushioning is further improved.

In addition, the reason for this is that such a rubber material is easily applied to a screen printing method, roll screening, or the like and has good adhesion to the bag-shaped object.

Further, although not shown, it is preferable that an anti-slip portion is provided on a back surface of the cushion.

The reason for this is that by providing the anti-slip portion in such a manner, a frictional force between the cushion and a surface on which the cushion is installed can be improved and it can be difficult for the cushion to slip off from the surface on which the cushion is installed.

In addition, a shape or a material of the anti-slip portion provided on the back surface of the cushion is not particularly limited, but from the viewpoint of anti-slip property, it is preferable that the shape or the material is the same as that of the anti-slip portion provided on the seating portion.

7. Filling Port

It is preferable that although not particularly shown, the bag-shaped object is provided with at least one hole portion as a filling port of the filling air that can introduce the air from the outside of the bag-shaped object.

Specifically, it is preferable that at least one of the second air chamber and the third air chamber of the bag-shaped object is provided with the filling port of the filling air.

In addition, when the bag-shaped object includes the fourth air chamber, it is preferable that at least one of the second to fourth air chambers is provided with the filling port of the filling air.

The reason for this is that by providing the filling port, the inside of the bag-shaped object can be more quickly and easily filled with the air and when the user is seated, the user and the filling port can be effectively prevented from interfering with each other.

In addition, the filling port is disposed below the second air chamber or below the third air chamber.

The reason for this is that by disposing the filling port in such a manner, the first air chamber can be more quickly filled with the air and when the user is seated, the user and the filling port can be more effectively prevented from interfering each other.

In addition, it is preferable that a diameter of the filling port is determined in consideration of handleability or the like, but normally, the diameter is preferably set to a value within a range of 3 to 30 mm.

The reason for this is that, in order to improve handleability or the like, a commercially available air pump may be used or air filling can be performed by direct blowing from the mouth, and the inside of the bag-shaped object can be more quickly and easily filled with the air.

Therefore, the diameter of the filling port is more preferably set to a value within a range of 4 to 20 mm, further preferably a value within a range of 5 to 10 mm.

In addition, it is preferable that the filling port is provided with a connector to be connected with an air filling device to be described later.

Specifically, it is preferable that at least one of a hose joint, a threaded coupler, a fitting coupler, a one-touch coupler, and the like is provided as the connector.

The reason for this is that a backflow of the filling air can be effectively prevented and the filling port can be easily attached to and detached from the air filling device to be described later.

In addition, when a plurality of the filling ports is provided, it is preferable that the number of the filling ports is set to a value within a range of 2 to 4.

The reason for this is that the bag-shaped object can be more quickly filled with the air by providing the filling port in each air chamber.

Second Embodiment

Figure 6:
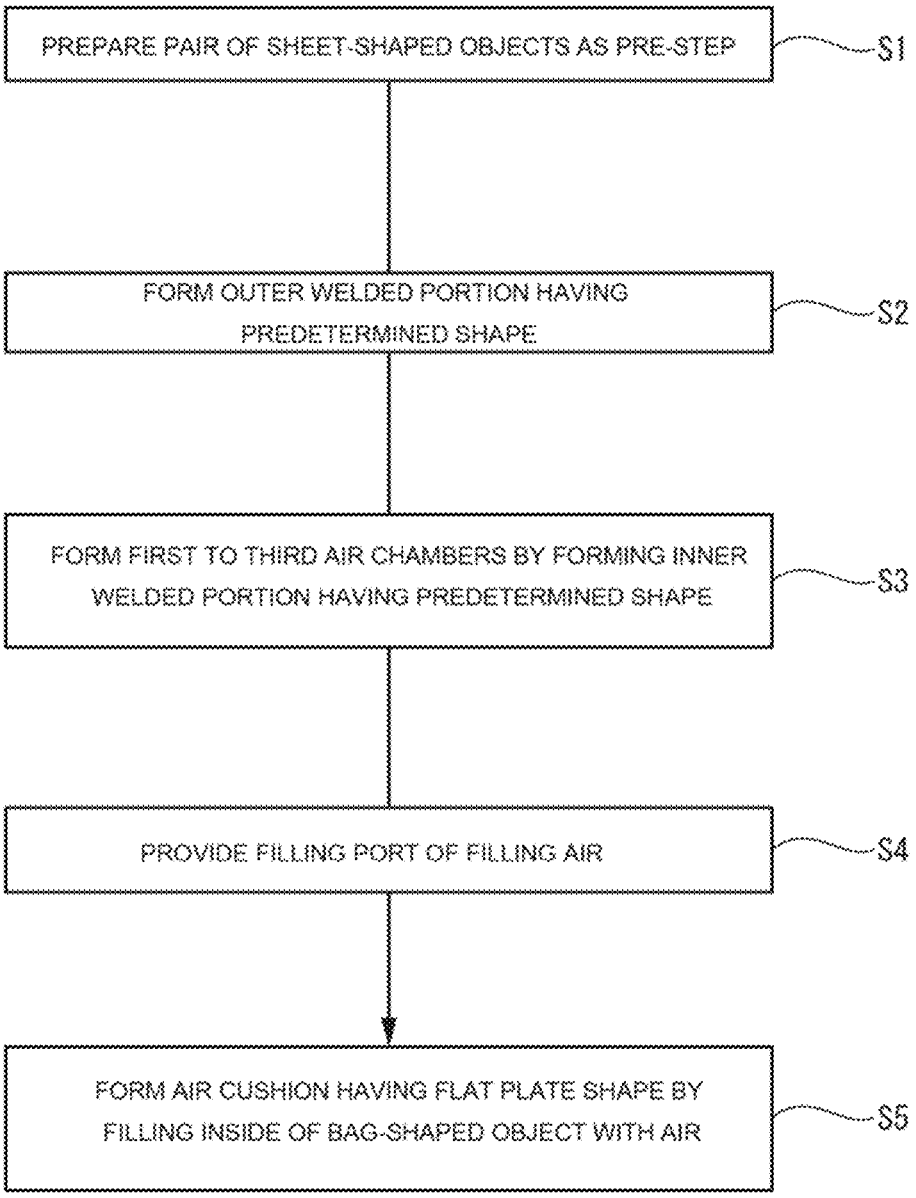
FIG. 6 is a flowchart provided to describe a method for manufacturing an air cushion of a second embodiment.

As illustrated in FIG. 6, a second embodiment is a method for manufacturing the air cushion of the first embodiment, and is a method for manufacturing the air cushion including the following steps (A) to (D).

(A) A step of forming a flat bag-shaped object including an outer welded portion by welding a pair of sheet-shaped objects along an outer peripheral portion.

(B) A step of forming the flat bag-shaped object such that a first air chamber as a seating portion, a second air chamber as a side support portion disposed on a left of the first air chamber, and a third air chamber as a facing side support portion disposed on a right of the first air chamber are formed by welding a predetermined location inside the flat bag-shaped object and the first air chamber communicates with the second air chamber and with the third air chamber through respective passage portions such that filling air moves between the first air chamber, the second air chamber, and the third air chamber.

(C) A step of providing at least one filling port of the filling air in the flat bag-shaped object.

(D) A step of forming an air cushion by introducing the filling air through the filling port provided in the flat bag-shaped object.

Hereinafter, an embodiment of the method for manufacturing the air cushion of the invention will be specifically described with reference to the drawings as appropriate.

Incidentally, a description of repeated portions from the first embodiment will not be repeated as appropriate.

1. Pre-Step

First, as a pre-step, a pair of sheet-shaped objects for forming a predetermined bag-shaped object are prepared (refer to step S1 in FIG. 6).

Incidentally, it is preferable that contents of the bag-shaped object are basically the same as the contents already described in the first embodiment, so that the description will not be repeated here again.

2. Step (A)

Step (A) is a step of forming an outer welded portion by welding a part of the pair of sheet-shaped objects along an outer periphery using a predetermined welding device (refer to step S2 in FIG. 6).

Specifically, it is preferable that a welding surface is formed into a flat or embossed shape by performing welding through heating, pressurizing, or the like using at least one of a soldering iron welder, a hot plate welder, a hot air welder, a high frequency welder, an ultrasonic welder, a laser welder, and the like as the welding device.

The reason for this is that welding unevenness can be prevented and a welded portion having a predetermined shape can be easily formed.

In addition, it is preferable that the outer welded portion is formed by a method in which welding is done at once by a large welding device or by a method in which small welded portions are caused to partially overlap each other by a small welding device.

In addition, a welding temperature varies depending on a type of a welding device to be used, a welding time, or the like, but normally, is preferably a value within a range of 80 to 500° C.

The reason for this is that a deformation or an appearance defect of the bag-shaped object can be prevented from occurring and firm welding becomes easier.

Therefore, the welding temperature is more preferably a value within a range of 100 to 400° C., further preferably a value within a range of 150 to 300° C.

3. Step (B)

Step (B) is a step of forming at least first to third air chambers by forming an inner welded portion (refer to step S3 in FIG. 6).

Specifically, a first inner welded portion is formed to form the first air chamber in front of the first inner welded portion and to form each of the second air chamber and the third air chamber.

4. Step (C)

Step (C) is a step of providing at least one filling port of filling air in the flat bag-shaped object (refer to step S4 in FIG. 6).

Specifically, it is preferable that a predetermined hole portion is formed in at least one of the second air chamber and the third air chamber as the filling port by a hole punching tool, an eyelet punching tool, a prick punch, a drill, a laser, and the like.

The reason for this is that by using such a tool, the hole portion can be more efficiently formed even by a simple tool.

5. Step (D)

Step (D) is a step of forming an air cushion having a flat plate shape by filling the bag-shaped object with the air through the filling port using a predetermined air filling device (refer to step S5 in FIG. 6).

Specifically, the air filling device may be a device that can fill the inside of the bag-shaped object with the air, but normally, it is preferable that the inside of the bag-shaped object is filled with the air using at least one of a diaphragm pump, a bellows pump, an electromagnetic pump, a piston pump, and the like.

In addition, a discharge air amount of an air pump varies depending on the pump to be used, but normally, is preferably a value within a range of 0.1 to 120 L/min.

The reason for this is that the inside of the bag-shaped object can be quickly filled with the air and the air cushion having a flat plate shape can be more easily formed.

Therefore, the discharge air amount of the air pump is more preferably set to a value within a range of 0.5 to 50 L/min, further preferably a value within a range of 1 to 30 L/min.

6. Modification Example

In addition, regarding carrying out a method for manufacturing an air cushion including a fourth air chamber, as a modification example of the second embodiment, a method for manufacturing a fourth air chamber by forming a predetermined second inner welded portion after forming a first inner welded portion is also suitable.

Namely, it is also preferable that the air cushion is manufactured by the following step (A') to step (D').

(1) Step (A')

Similarly to step (A), an outer welded portion is formed.

(2) Step (B')

Next, a first inner welded portion is formed to form a first air chamber in front of the first inner welded portion, and a second inner welded portion is formed to form a fourth air chamber behind the second inner welded portion.

Further, a second air chamber and a third air chamber are formed on a left of and on a right of the first air chamber, respectively, by joining the first inner welded portion and the second inner welded portion through welding.

(3) Step (C')

Next, similarly to step (C), a filling port of filling air is provided.

(4) Step (D')

Next, similarly to step (D), a bag-shaped object is filled with the air through the filling port to form an air cushion having a flat plate shape.

Third Embodiment

Figure 7:
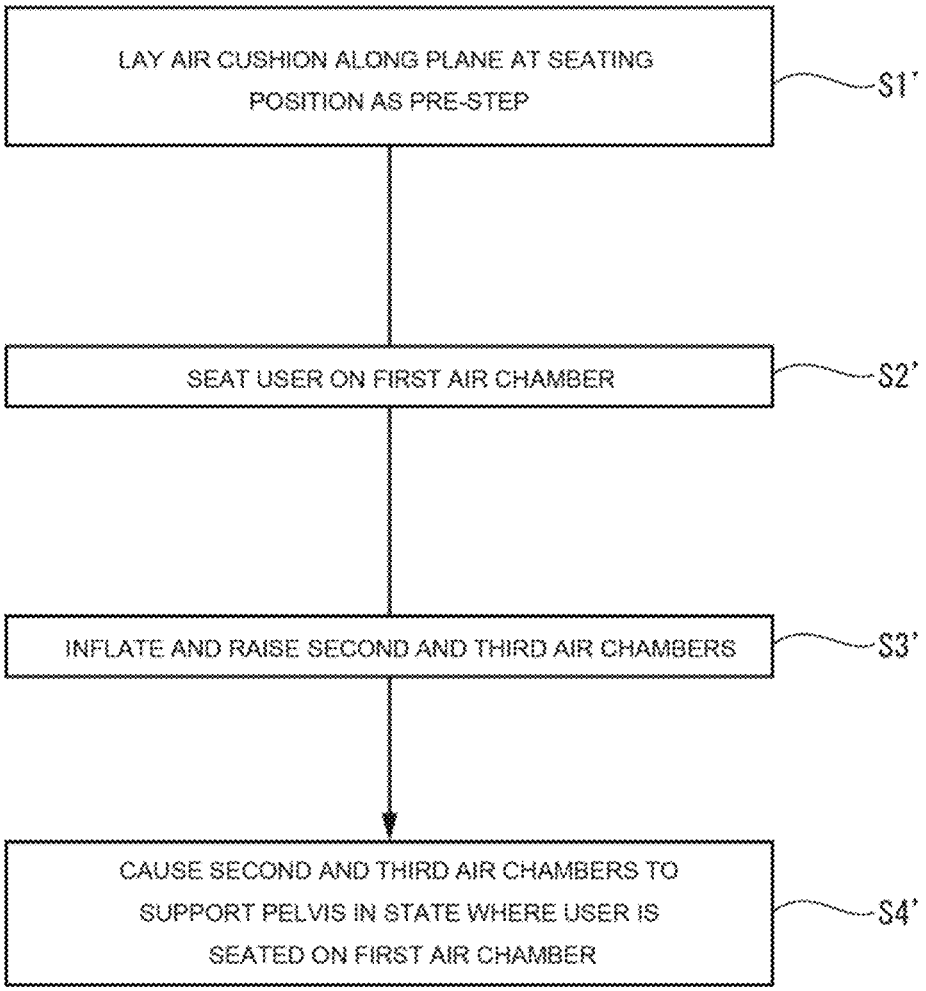
FIG. 7 is a flowchart provided to describe a method for manufacturing an air cushion of a third embodiment.

As illustrated in FIG. 7, a third embodiment is a method for using the air cushion of the first embodiment, and is a method for using the air cushion including the following steps (i) to (iii).

(i) Step of seating on the first air chamber.

(ii) Step of inflating and raising the second air chamber and the third air chamber by causing the filling air in the first air chamber to flow into the second air chamber and into the third air chamber.

(iii) Step of supporting the pelvis by causing the buttocks and the lumbar to come into contact with the second air chamber and with the third air chamber that are raised.

Hereinafter, an embodiment of the method for using the air cushion of the invention will be specifically described with reference to the drawings as appropriate.

Incidentally, a description of repeated portions from the first and second embodiments will not be repeated as appropriate.

1. Pre-Step

First, as a pre-step, it is preferable that a predetermined air cushion is disposed along a plane at a seating position (refer to step S1' in FIG. 7).

Incidentally, it is preferable that contents of or a use method for the air cushion is basically the same as that already described in the first and second embodiments, so that the description will not be repeated here again.

2. Step (i)

Step (i) is a step of causing a user to be seated in the predetermined air cushion (refer to step S2' in FIG. 7).

Specifically, the step is such that the user is seated with the lumbar facing rearward and the buttocks placed on the first air chamber.

Incidentally, step (i) may be performed substantially simultaneously with step (ii) to be described later.

At this time, it is preferable that the user is seated with a center position of the lumbar in the left-right direction aligned with a center position of the first air chamber in the left-right direction, but for example, there may be a slight offset of approximately 50 mm to the left or to the right.

The reason for this is that even when the user is seated with an offset to the left or to the right in such a manner, the second air chamber and the third air chamber can be deformed to more effectively prevent support for the pelvis from degrading.

3. Step (ii)

Step (ii) is a step of raising the second and third air chambers (refer to step S3' in FIG. 7).

Specifically, the step is such that the air in the first air chamber flows into the second air chamber and into the third air chamber to inflate each air chamber, thereby increasing the height of the second air chamber and of the third air chamber to a predetermined height larger than a thickness of the first air chamber.

In addition, when a height of a predetermined air chamber in a raised state is too high, the height can be adjusted by deflating the air with which the inside of the bag-shaped object is filled or by seating further forward to reduce an air amount to be pushed out from the first air chamber.

Furthermore, when a height of a predetermined air chamber in a raised state is too low, conversely, the height can be adjusted by further filling the bag-shaped object with air or by seating further rearward to increase an air amount to be pushed out from the first air chamber.

In addition, it is preferable that it takes no time from when the user is seated, to raise a predetermined air chamber, but it is also preferable that in order to adjust the height in a raised state, the predetermined air chamber rises within a range of 1 to 10 seconds from when the user is seated.

Therefore, the time to raise the predetermined air chamber is more preferably set to a value within a range of 2 to 8 seconds, further preferably a value within a range of 3 to 5 seconds.

4. Step (iii)

Step (iii) is a step of supporting the pelvis (refer to step S4' in FIG. 7).

Specifically, the step is such that the second and third air chambers that are raised press the periphery of the pelvis to support the pelvis at a predetermined inclination angle.

Figure 8A:
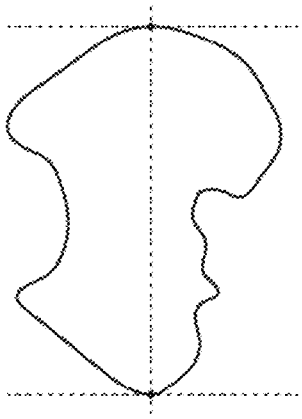
FIGS. 8A to 8C are views provided to describe an inclination angle of the pelvis.
Figure 8B:
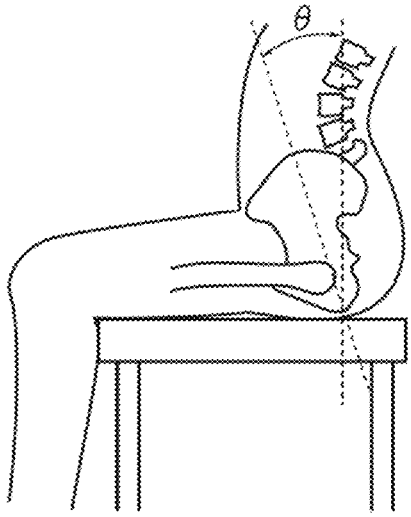
Figure 8C:
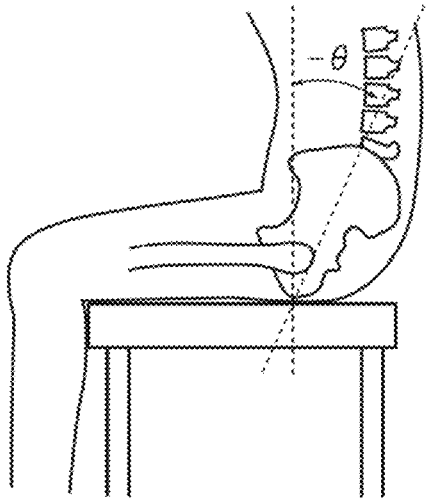

Furthermore, it is preferable that as shown in FIGS. 8A to 8C, a state where an imaginary straight line passing through upper and lower apexes of the pelvis along the vertical direction is inclined forward with respect to the vertical direction is defined as being positive, a state where the imaginary straight line is inclined rearward is defined as being negative, and an inclination angle θ of the pelvis to be supported is set to a value within a range of −30 to 30°.

The reason for this is that a burden on the lumbar spine or on the thoracic vertebrae can be more effectively reduced by supporting at such an inclination angle.

Therefore, the inclination angle θ of the pelvis to be supported is more preferably set to a value within a range of −20 to 20°, further preferably a value within a range of −10 to 10°.

5. Modification Example

In addition, regarding carrying out a method for using the air cushion including the fourth air chamber, as a modification example of the third embodiment, a use method is also suitable in which the pelvis is supported at a predetermined inclination angle by inflating the fourth air chamber and by pressing the periphery of the lumbar with the fourth air chamber that is raised.

Namely, it is also preferable that the air cushion is used by the following step (i') to step (iii').

(1) Step (i')

Similarly to step (i), step (i') is a step of causing a user to be seated.

Incidentally, step (i') may be performed substantially simultaneously with step (ii') to be described later.

(2) Step (ii')

Step (ii') is a step of raising the second to fourth air chambers.

Specifically, the step is such that the air in the first air chamber flows into the second air chamber and into the third air chamber to inflate each air chamber, thereby increasing the height of the second air chamber and of the third air chamber to a predetermined height larger than a thickness of the first air chamber.

Further, the step is such that the air that has flowed into the first air chamber pushes out the air in the second air chamber and in the third air chamber, and causes the air to flow into and inflate the fourth air chamber, thereby increasing the height of the fourth air chamber to a predetermined height larger than the thickness of the first air chamber.

(3) Step (iii')

Step (iii') is a step of supporting the pelvis.

Specifically, the step is such that the second to fourth air chambers that are raised press the periphery of the lumbar to support the pelvis at a predetermined inclination angle.

EXAMPLES

Hereinbelow, the invention will be further described in detail using examples.

However, the invention is not limited to a description of the following examples without any particular reason.

Example 1

1. Manufacturing Air Cushion

Figure 4B:
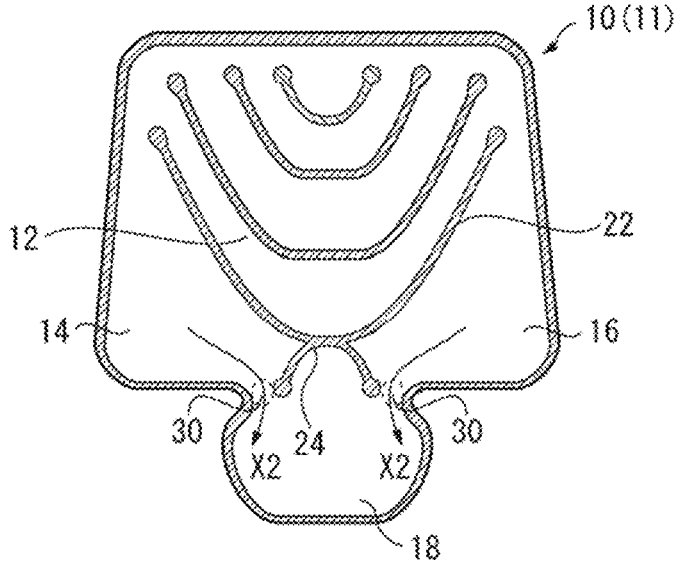

The air cushions shown in FIG. 4B were manufactured by the above-described method.

Specifically, as a forming material of a flat bag-shaped object, a pair of sheet-shaped objects each having an inverted pot shape and having a maximum diameter of 600 mm were prepared.

Next, the pair of sheet-shaped objects each having an inverted pot shape were welded along an outer periphery to form the flat bag-shaped object.

Further, in the obtained flat bag-shaped object, a first inner welded portion having a U character, three secondary first inner welded portions each having a U character, and a second inner welded portion having an inverted U character were formed to form each of a first air chamber, a second air chamber, a third air chamber, and a fourth air chamber.

In this case, an end portion-to-end portion distance of the first inner welded portion was 350 mm, a distance between the first inner welded portion and the secondary first inner welded portion adjacent to the first inner welded portion and distances between the three secondary first inner welded portions were 125 mm, 80 mm, and 73 mm sequentially from the rear, respectively.

Finally, the flat bag-shaped object was provided with a filling port of filling air and was filled with the air through the provided filling port to obtain the air cushion shown in FIG. 4B.

In this case, a thickness (H1) of a bag-shaped portion of the air cushion filled with the air was 50 mm, and a thickness (H4) of the first air chamber 12 was 40 mm.

2. Evaluation of air cushion (1) Evaluation 1: seating comfort performance for chair with seating surface made of acrylic A chair with a seating surface made of acrylic was prepared and the manufactured air cushion was installed on the seating surface of the chair.

Next, an evaluator weighing 80 kg was seated on the air cushion with both feet on the ground without leaning the back against a backrest such that an angle between the knee and the thigh was 90°, seating comfort performance of the air cushion was evaluated in accordance with the following criteria, and an obtained evaluation result was shown in Table 1.

⊙ (Very Good): Seating comfort was considerably improved compared to when the air cushion was not used.

○ (Good): Seating comfort was improved compared to when the air cushion was not used.

Δ (Fair): No change was observed in seating comfort compared to when the air cushion was not used.

X (Bad): Seating comfort became worse compared to when the air cushion was not used.

(2) Evaluation 2: seating pressure distribution in chair with seating surface made of acrylic A chair with a seating surface made of acrylic and a seat-type pressure measurement device (X3 Pro Electronics manufactured by Xsensor Technology Corporation) were prepared, and a seat sensor of the seat-type pressure measurement device was installed on the seating surface of the chair.

Figure 9A:
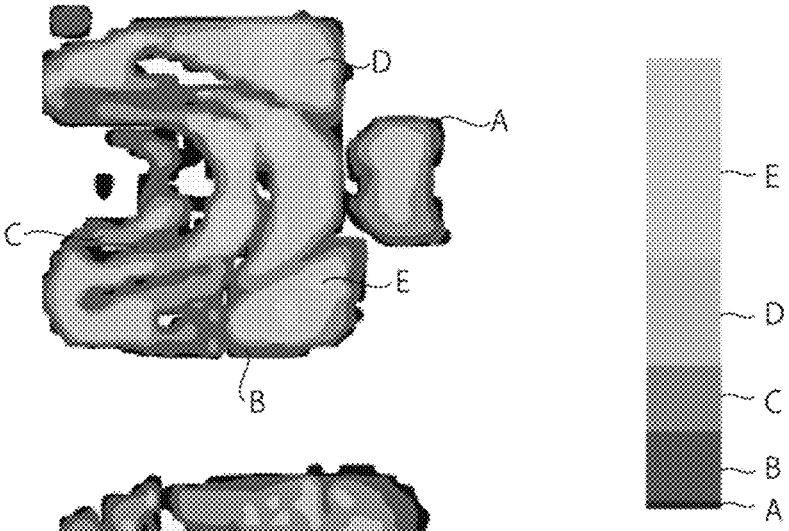
FIGS. 9A to 9C are images provided to show seating pressure distributions when the cushion of the first embodiment is installed on a chair with a seating surface made of acrylic and a user is seated.

Next, the manufactured air cushion was installed on the seat sensor, and a seating pressure distribution was measured in a state where an evaluator weighing 80 kg was seated on the air cushion with both feet on the ground without leaning the back against a backrest such that an angle between the knee and the thigh was 90°. As shown in FIG. 9A, the seating pressure distribution obtained by the measurement was divided into five regions in which a region having a seating pressure of below 1 kPa was defined as a region A, a region having a seating pressure of 1 kPa or more and less than 4 kPa was defined as a region B, a region having a seating pressure of 4 kPa or more and less than 7.5 kPa was defined as a region C, a region having a seating pressure of 7.5 kPa or more and less than 12.5 kPa was defined as a region D, and a region having a seating pressure of above 12.5 kPa was defined as a region E.

Further, the seating pressure distribution divided into the five regions was evaluated in accordance with the following criteria, and an obtained evaluation result was shown in Table 1.

⊙ (Very Good): A place where the seating pressure was concentrated was not observed at all.

○ (Good): A place where the seating pressure was concentrated was slightly observed.

Δ (Fair): A place where the seating pressure was concentrated was observed.

X (Bad): A place where the seating pressure was remarkably concentrated was observed.

(3) Evaluation 3: Seating Comfort Performance for Chair with Urethane Cushion on Seating Surface A chair with a urethane cushion on a seating surface was prepared and the manufactured air cushion was installed on the seating surface of the chair.

Next, an evaluator weighing 80 kg was seated on the air cushion with both feet on the ground without leaning the back against a backrest such that an angle between the knee and the thigh was 90°, seating comfort performance of the air cushion was evaluated in accordance with the following criteria, and an obtained evaluation result was shown in Table 1.

⊙ (Very Good): Seating comfort was considerably improved compared to when the air cushion was not used.

○ (Good): Seating comfort was improved compared to when the air cushion was not used.

Δ (Fair): No change was observed in seating comfort compared to when the air cushion was not used.

X (Bad): Seating comfort became worse compared to when the air cushion was not used.

(4) Evaluation 4: Seating Pressure Distribution in Chair with Urethane Cushion on Seating Surface A chair with a urethane cushion on a seating surface and a seat-type pressure measurement device (X3 Pro Electronics manufactured by Xsensor Technology Corporation) were prepared, and a seat sensor of the seat-type pressure measurement device was installed on the seating surface of the chair.

Figure 10A:
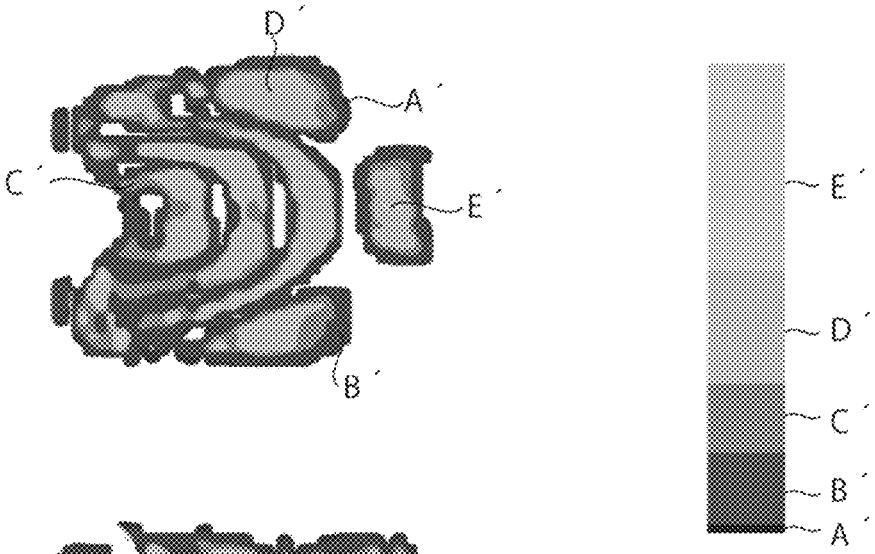
FIGS. 10A to 10C are images provided to show seating pressure distributions when the cushion of the first embodiment is installed on a chair with a urethane cushion on a seating surface and the user is seated.

Next, the manufactured air cushion was installed on the seat sensor, and a seating pressure distribution was measured in a state where an evaluator weighing 80 kg was seated on the air cushion with both feet on the ground without leaning the back against a backrest such that an angle between the knee and the thigh was 90°. As shown in FIG. 10A, the seating pressure distribution obtained by the measurement was divided into five regions in which a region having a seating pressure of below 1 kPa was defined as a region A', a region having a seating pressure of 1 kPa or more and less than 2.5 kPa was defined as a region B', a region having a seating pressure of 2.5 kPa or more and less than 5 kPa was defined as a region C', a region having a seating pressure of 5 kPa or more and less than 8.5 kPa was defined as a region D', and a region having a seating pressure of above 8.5 kPa was defined as a region E'.

Further, the seating pressure distribution divided into the five regions was evaluated in accordance with the following criteria, and an obtained evaluation result was shown in Table 1.

⊙ (Very Good): A place where the seating pressure was concentrated was not observed at all.

○ (Good): A place where the seating pressure was concentrated was slightly observed.

Δ (Fair): A place where the seating pressure was concentrated was observed.

X (Bad): A place where the seating pressure was remarkably concentrated was observed.

Example 2

In Example 2, as shown in FIG. 3B, an air cushion that included three inner welded portions each having a U character, a second inner welded portion having an inverted V character, and a fourth air chamber as a rear support portion, and that was the same as that of Example 1 except for the following configurations was manufactured and evaluated.

Namely, in the manufactured air cushion, a maximum diameter of the flat bag-shaped object was 675 mm, an end portion-to-end portion distance of the first inner welded portion was 365 mm, and a distance between the first inner welded portion and the secondary first inner welded portion adjacent to the first inner welded portion and a distance between the secondary first inner welded portions were 130 mm and 80 mm, respectively.

In addition, a thickness (H1) of a bag-shaped portion of the air cushion filled with the air was 60 mm, and a thickness (H4) of the first air chamber 12 was 50 mm.

Figure 9B:
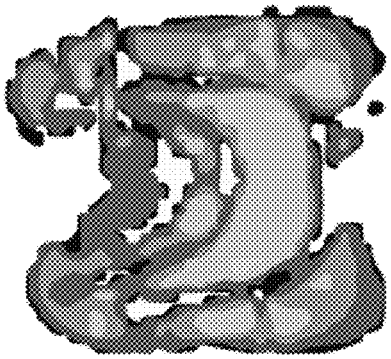
Figure 10B:
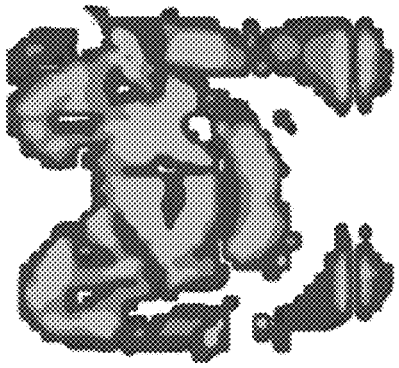

Further, obtained evaluation results, a seating pressure distribution in a chair with a seating surface made of acrylic, and a seating pressure distribution in a chair with a urethane cushion on a seating surface were shown in Table 1, in FIG. 9B, and in FIG. 10B, respectively.

Example 3

In Example 3, as shown in FIG. 1B, an air cushion that included three inner welded portions each having a U character, a second inner welded portion having an inverted V character, and a lower outer peripheral portion having a twin peak shape, and that was the same as that of Example 1 except for the following configurations was manufactured and evaluated.

Namely, in the manufactured air cushion, a maximum diameter of the flat bag-shaped object was 665 mm, an end portion-to-end portion distance of the first inner welded portion was 375 mm, and a distance between the first inner welded portion and the secondary first inner welded portion adjacent to the first inner welded portion and a distance between the secondary first inner welded portions were 100 mm and 80 mm, respectively.

In addition, a thickness (H1) of a bag-shaped portion of the air cushion filled with the air was 60 mm, and a thickness (H4) of the first air chamber 12 was 50 mm.

Figure 9C:
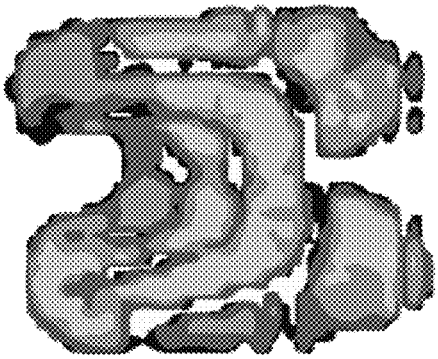
Figure 10C:
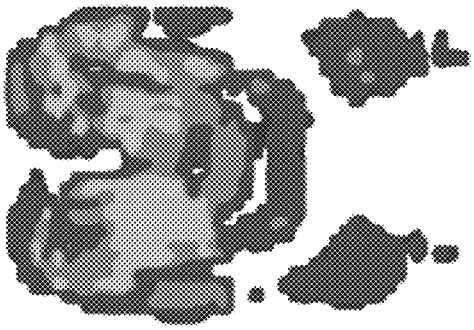

Further, obtained evaluation result, a seating pressure distribution in a chair with a seating surface made of acrylic, and a seating pressure distribution in a chair with a urethane cushion on a seating surface were shown in Table 1, in FIG. 9C, and in FIG. 10C, respectively.

Comparative Example 1

Figure 9D:
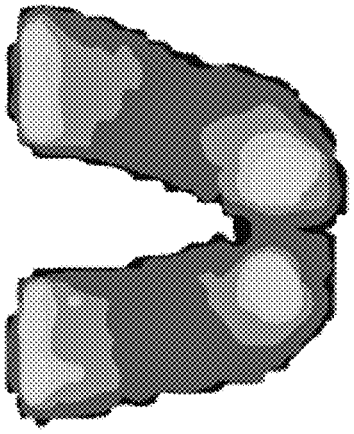
FIG. 9D is an image provided to show a seating pressure distribution when the user is directly seated in the chair with the seating surface made of acrylic.
Figure 10D:
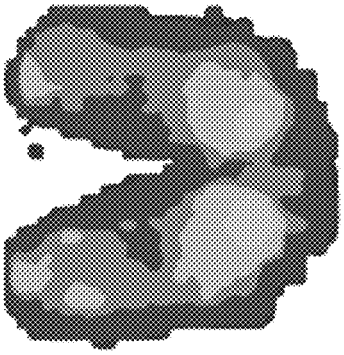
FIG. 10D is an image provided to show a seating pressure distribution when the user is directly seated in a chair with a seating surface made of acrylic.
Figure 11A:
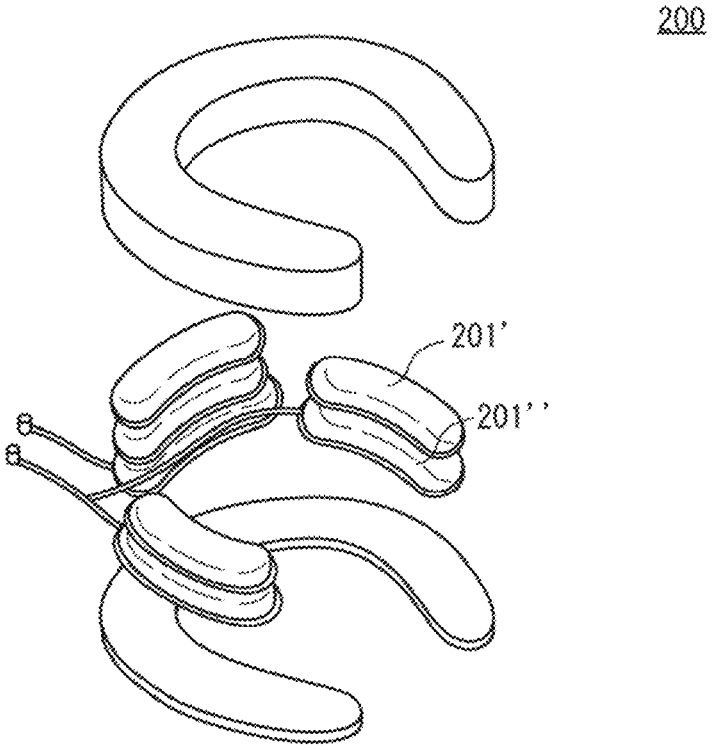
FIGS. 11A and 11B are views provided to describe respective cushions in the related art.
Figure 11B:
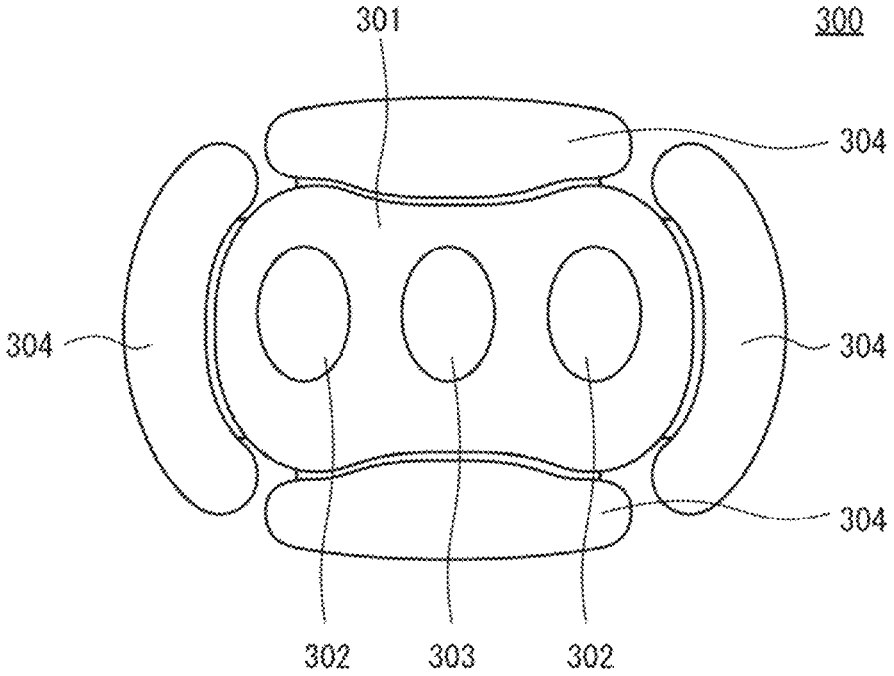

In Comparative Example 1, an evaluation was performed in the same manner as in Example 1 except that an air cushion was not used. Obtained results, a seating pressure distribution in a chair with a seating surface made of acrylic, and a seating pressure distribution in a chair with a urethane cushion on a seating surface were shown in Table 1, in FIG. 9D, and in FIG. 10D, respectively.

TABLE 1

| | Evaluation 1 | Evaluation 2 | Evaluation 3 | Evaluation 4 |
|---|---|---|---|---|
| Example 1 | ○ | ○ | ○ | ○ |
| Example 2 | ⊙ | ⊙ | ○ | ○ |
| Example 3 | ⊙ | ⊙ | ⊙ | ⊙ |
| Comparative Example 1 | Δ | X | Δ | Δ |

INDUSTRIAL APPLICABILITY

As described above, according to the air cushion of, the method for manufacturing the air cushion of, and the method for using the air cushion of the invention, regardless of inclination of the body of a user in the left-right direction, good support for the pelvis can be provided by providing a plurality of air chambers through a predetermined inner welded portion.

Namely, in the air cushion, when the user is seated, the air can stably flow and a rising characteristic of the air chambers around the lumbar can be further improved.

Furthermore, the second air chamber and the third air chamber can be appropriately deformed to prevent the body from being fixed, and even when the body is inclined to the left or to the right, good support for the pelvis can be maintained.

Therefore, it is expected that the air cushion of the invention is used to prevent lumbar pain, intervertebral disc herniation, or the like by supporting forward and rearward inclination of the pelvis when the user is seated in a state where it is difficult for a burden to be applied to the lumbar spine or to the thoracic vertebrae.

In addition, since a rising characteristic of the air chambers is good, it is expected that the air cushion of the invention is used as a seating surface of a seat for automobile, a legless chair, or the like.

Further, it is also expected that since a fluid provides good internal sealability and has good fluidity when the inside is filled with the fluid, the inside is filled with liquid instead of the air to obtain a water cushion that provides good support for the pelvis.

Therefore, it is expected that the invention is not only used for a cushion used as a floor cushion, but also widely used for a seat for vehicle, a chair, a legless chair, a bed, a pillow, and the like.

The invention claimed is:

1. An air cushion including an outer welded portion along an outer peripheral portion of a flat bag-shaped object, the cushion comprising:

when viewed from above, at least a first air chamber as a seating portion;

a second air chamber as a side support portion disposed on a left of the first air chamber; and a third air chamber as a facing side support portion disposed on a right of the first air chamber, wherein the first air chamber communicates with the second air chamber and with the third air chamber through respective passage portions such that filling air moves between the first air chamber, the second air chamber, and the third air chamber, and an inner welded portion is provided that has a U character and that divides the first air chamber, the second air chamber, and the third air chamber from each other, the outer welded portion of the second air chamber and the outer welded portion of the third air chamber are configured to be pivotally pushed up with respect to end portions of the inner welded portion on the second air chamber side and on the third air chamber side of the inner welded portion when a user is seated in the air cushion, and the second air chamber and the third air chamber are configured to rise to wrap a lumbar of the user.

2. The air cushion according to claim 1, wherein when the inner welded portion having a U character is used as a first inner welded portion, separately from the first inner welded portion, one or a plurality of secondary first inner welded portions each having a U character are provided in the first air chamber at predetermined intervals, and the number of the secondary first inner welded portions is within a range of 2 to 10.

3. The air cushion according to claim 1, wherein when the inner welded portion having a U character is used as a first inner welded portion, a second inner welded portion is provided that is in contact with the first inner welded portion and that has at least one shape selected from a square shape, a rectangular shape, an inverted V character, and an inverted U character when viewed from above.

4. The air cushion according to claim 1, further comprising:

a fourth air chamber as a rear support portion disposed behind the first air chamber.

5. The air cushion according to claim 1, wherein when viewed from above, the flat bag-shaped object has a twin peak shape in which a lower outer peripheral portion of the flat bag-shaped object extends over the second air chamber and the third air chamber.

6. The air cushion according to claim 1, further comprising:

an additional inner welded portion having a horizontal shape or a curved shape and extending over the second air chamber and the third air chamber.

7. The air cushion according to claim 1, wherein an anti-slip portion having a predetermined regular pattern or a random pattern is provided on a surface of the seating portion.

8. The air cushion according to claim 1, wherein at least one of the second air chamber and the third air chamber is provided with a filling port of the filling air.

9. The air cushion according to claim 1, the second air chamber and the third air chamber are configured to rise in an inclined state when the user is seated in the air cushion and the filling air of the first air chamber flows into the second air chamber and into the third air chamber through the respective passage portions.

10. The air cushion according to claim 1, the inner welded portion is configured to move toward an installed surface of the air cushion when the user is seated in the air cushion.

11. The air cushion according to claim 1, the second air chamber and the third air chamber are configured to rise in an inclined state when the user is seated in the air cushion so that a height of an uppermost portion of the flat bag-shaped object forming the second air chamber and the third air chamber from an installed surface of the air cushion is within a range of 50 to 250 mm.

* * * * *